US010919140B2

(12) United States Patent
Tsai

(10) Patent No.: US 10,919,140 B2
(45) Date of Patent: Feb. 16, 2021

(54) HANDLE FOR HAND TOOL

(71) Applicant: Ching-Ching Tsai, Taichung (TW)

(72) Inventor: Ching-Ching Tsai, Taichung (TW)

( * ) Notice: Subject to any disclaimer, the term of this patent is extended or adjusted under 35 U.S.C. 154(b) by 231 days.

(21) Appl. No.: 16/131,534

(22) Filed: Sep. 14, 2018

(65) Prior Publication Data

US 2019/0009401 A1 Jan. 10, 2019

Related U.S. Application Data

(63) Continuation-in-part of application No. 14/940,203, filed on Nov. 13, 2015, now abandoned.

(51) Int. Cl.

| | |
|---|---|
| ***B25G 1/10*** | (2006.01) |
| ***B25B 15/04*** | (2006.01) |
| ***B25B 23/16*** | (2006.01) |
| ***B25B 15/02*** | (2006.01) |

(52) U.S. Cl.

CPC ..... *B25G 1/102* (2013.01); *B25B 15/02* (2013.01); *B25B 15/04* (2013.01); *B25B 23/16* (2013.01)

(58) Field of Classification Search

CPC ..... B25G 1/102; B25G 1/10; B25B 15/02; B25B 15/04; B25B 23/16; B25B 13/48; B25B 13/481; B25B 13/5091; B25B 17/00; E21B 19/16

See application file for complete search history.

(56) References Cited

U.S. PATENT DOCUMENTS

| | | | | |
|---|---|---|---|---|
| 2,635,660 | A | 4/1953 | Dawson | |
| 5,267,487 | A * | 12/1993 | Falco | B62D 1/06 428/36.1 |
| 2004/0050215 | A1 | 3/2004 | Hsieh | |
| 2004/0200079 | A1 * | 10/2004 | Stoughton | B25G 1/102 30/514 |
| 2009/0229427 | A1 * | 9/2009 | Badiali | B25G 1/005 81/177.1 |
| 2010/0107826 | A1 * | 5/2010 | Gauthier | B29C 45/0062 81/177.1 |

* cited by examiner

*Primary Examiner* — Robert J Scruggs
(74) *Attorney, Agent, or Firm* — Muncy, Geissler, Olds & Lowe, P.C.

(57) ABSTRACT

A handle of a hand tool includes a body made of a first material and a bit is connected to the bottom of the body. A buffering portion made of a second material integrally formed to the outside of the body. The second material has a proper elasticity and is less hard than the first material. A grasp portion made of a third material integrally formed with the buffering portion. The second material is less hard than the third material. The grasp portion has multiple recesses for easily grasp by the user. The buffering portion buffers or absorbs the shifting of the grasp portion to maintain the bit to be perpendicular to the top face of the bolt head so as to effectively drive the bolt.

16 Claims, 12 Drawing Sheets

HANDLE FOR HAND TOOL

The present invention is a CIP of application Ser. No. 14/940,203, filed Nov. 13, 2015, the entire contents of which are hereby incorporated by reference.

BACKGROUND OF THE INVENTION

Field of the Invention

Description of the Prior Art

The conventional hand tool such as a screwdriver generally comprises a handle and a shaft which extends from the handle. The shaft has a function end so as to be engaged with the head of a bolt for example. The user grasps the handle and rotates the hand tool to tighten or loosen the bolt. During rotating the hand tool, the user has keep the hand tool to be perpendicular to the top face of the bolt, once the shaft is inclined relative to the top face of the bolt, the bolt cannot be effectively rotated.

If the hand tool does not have a ratchet mechanism, the user has to rotate the hand tool to an angle, and then remove the hand from the handle and re-grasp the handle to a proper position so as to continue the rotational action. This takes a lot of time and reduces the efficiency.

The present invention intends to provide a handle of a hand tool to eliminate the shortcomings mentioned above.

SUMMARY OF THE INVENTION

The present invention relates to a handle of a hand tool and comprises a body made of a first material and a bit is connected to the bottom of the body. A buffering portion made of a second material is integrally formed to the outside of the body, and the second material has a proper elasticity and is less hard than the first material. A grasp portion made of a third material is integrally formed with the buffering portion. The second material is less hard than the third material.

Preferably, the buffering portion has at least one protrusion extending therefrom. The at least one protrusion is substantially perpendicular to the axis of the body. The grasp portion is integrally formed with the at least one protrusion.

Preferably, a cap is connected to the top of the body and the buffering portion.

Preferably, the body has an annular groove defined in the top thereof, and the cap has multiple engaging portions which are engaged with the annular groove such that the cap is rotatable relative to the body and the grasp portion.

Preferably, the grasp portion has multiple recesses defined in the outer periphery thereof.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
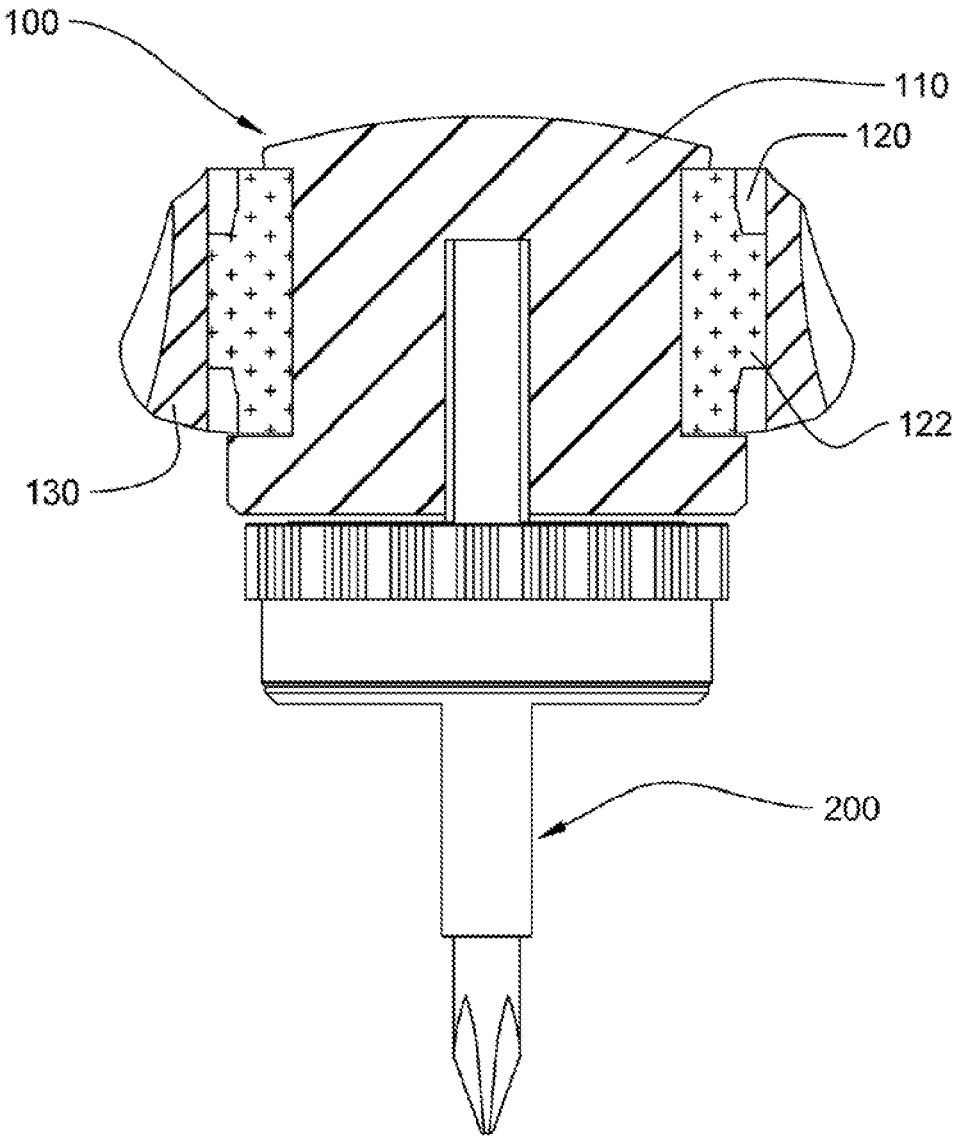
FIG. 1 is a partial cross sectional view of the handle of the present invention.

Referring to FIG. 1, the handle 100 of the present invention comprises a body 110 made of a first material and a bit 200 is connected to the bottom of the body 110. The bit 200 can be driven by a ratchet mechanism. The first material is formed by way of injection molding. A buffering portion 120 made of a second material is integrally formed to the outside of the body 110, wherein the second material is less hard than the first material. In other words, the second material has a proper elasticity. The buffering portion 120 has multiple protrusions 122 extending therefrom, wherein the profusions 122 are substantially perpendicular to an axis of the body 110. A grasp portion 130 made of a third material is integrally formed with the buffering portion 120, and the second material is less hard than the third material. The third material is also made by way of injection molding.

When manufacturing the handle 100, the body 110 and the grasp portion 130 are respectively made by way of injection molding, and the second material of the buffering portion 120 is injected between the grasp portion 130 and the body 110 to integrally form the handle 100 without any seam.

Figure 2:
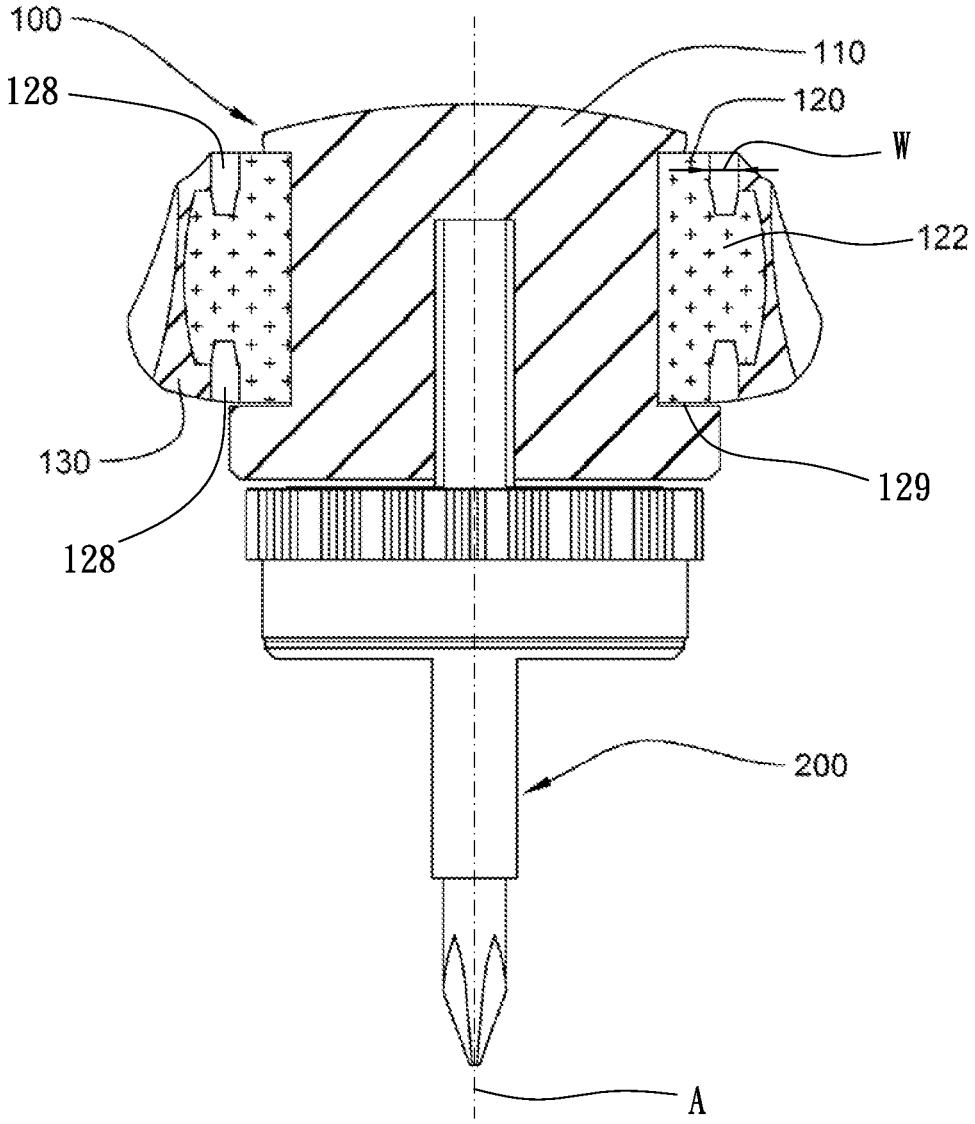
FIG. 2 is a partial cross sectional view of another embodiment of the handle of the present invention.

FIG. 2 shows another embodiment of the present invention, wherein the handle 100 comprises the body 110, the buffering portion 120 and the grasp portion 130, the difference from the previous embodiment is that when injecting the second material of the buffering portion 120, the protrusions 122 are partially or entirely embedded by the grasp portion 130 to enhance the connection between the buffering portion 120 and the grasp portion 130.

Figure 3:
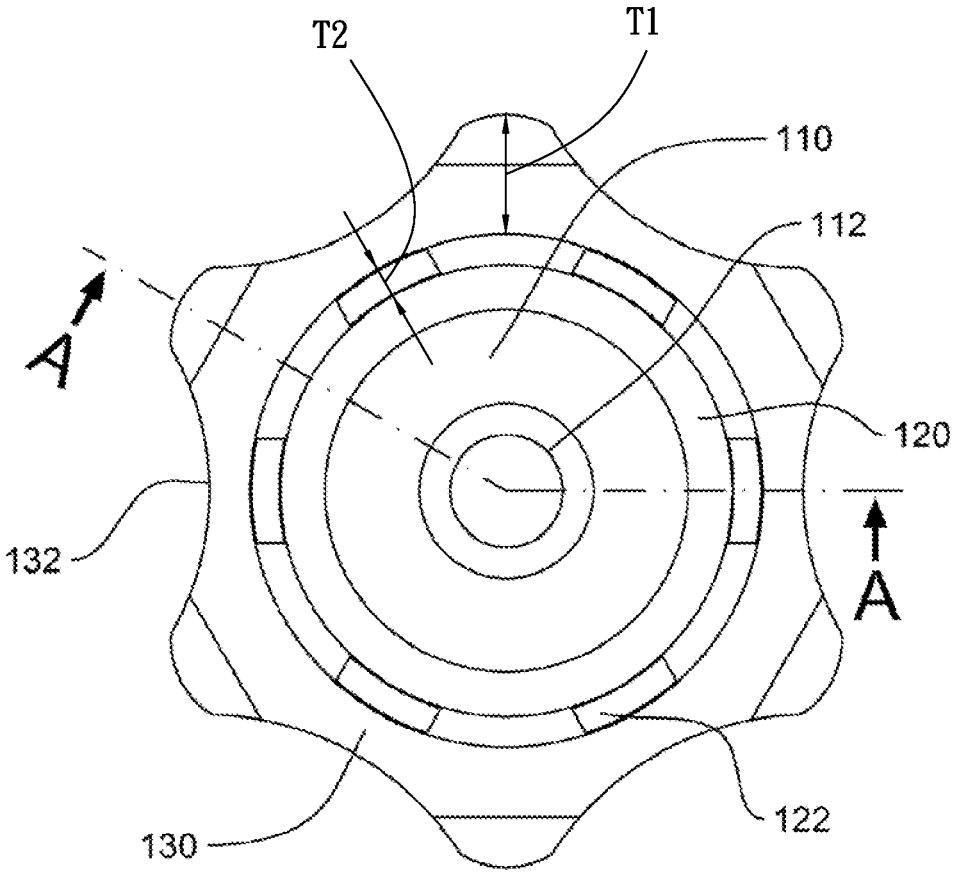
FIG. 3 is a top end view of another embodiment of the handle of the present invention without the cap.
Figure 4:
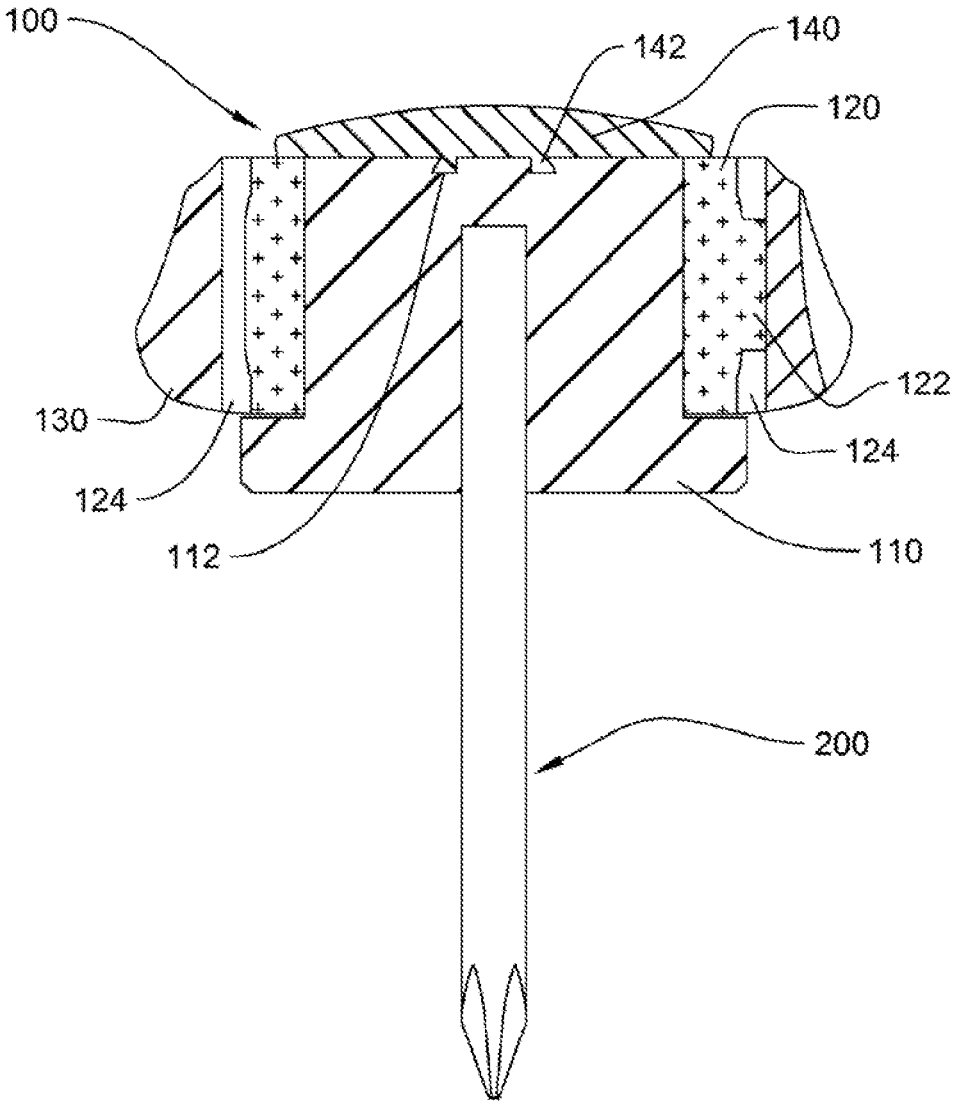
FIG. 4 is a cross sectional view, taken along line A-A in FIG. 3, wherein a cap is connected to the body.
Figure 5:
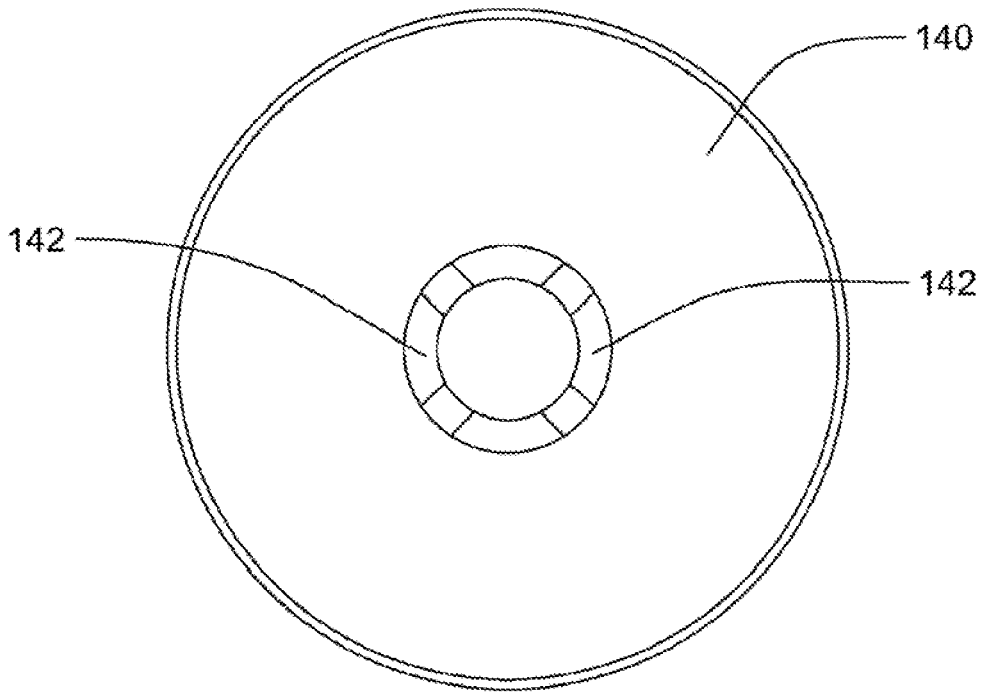
FIG. 5 is a bottom end view of the handle of the present invention in FIG. 4.

FIGS. 3 to 5 show another embodiment of the handle of the present invention, wherein the handle 100 comprises the body 110, the buffering portion 120, the grasp portion 130 and the cap 140. The bit 200 connected to the body of the body 110 is a straight bit. The buffering material 120 is connected to the outside of the body 110 and has multiple protrusions 122. The grasp portion 130 is connected to the outside of the buffering portion 120. The material of the buffering portion 120 is less hard than that of each of the body 110 and the grasp portion 130. The grasp portion 130 has multiple recesses 132 defined in the outer periphery thereof so that the user can easily and firmly grasp the handle 100.

The cap 140 is connected to the top of the body 110 and the buffering portion 120. The cap 140 has a curved top surface and has multiple engaging portions 142 which are separated from each other by a distance. The body 110 has an annular groove 112 defined in the top thereof, and the engaging portions 142 are engaged with the annular groove 112 such that the cap 140 is rotatable relative to the body 110 and the grasp portion 130. Therefore, by pressing the cap 140, the bit 200 can be engaged with the bolt without shifting.

When in use, the user presses the cap 140 and holds the body 110 to rotate the bit 200 to tighten or loosen the bolt, the cap 140 is rotatable relative to the body 110 so that the rotation of the cap 140 does not drive the body 110, such that the bit 200 does not disengaged from the bolt and does not shift relative to the bolt.

The grasp portion 130 is integrally formed with the protrusions 122 of the buffering portion 120, and the grasp portion 130 is not directly connected to the body 110 so that there is a room 124 formed between the grasp portion 130 and the body 110, as shown in FIG. 4, and also there is a room 124 between any of the two protrusions 122. There is a room respectively located above and beneath the single protrusion 122 as well. The buffering portion 120 is made by the material that is softer than the material of the body 110 and the grasp portion 130, so that the minor shifting of the grasp portion 130 can be buffered or absorbed by the buffering portion 120 such that the body 110 does not shift and the bit 200 does not removed from the bolt.

Figure 6:
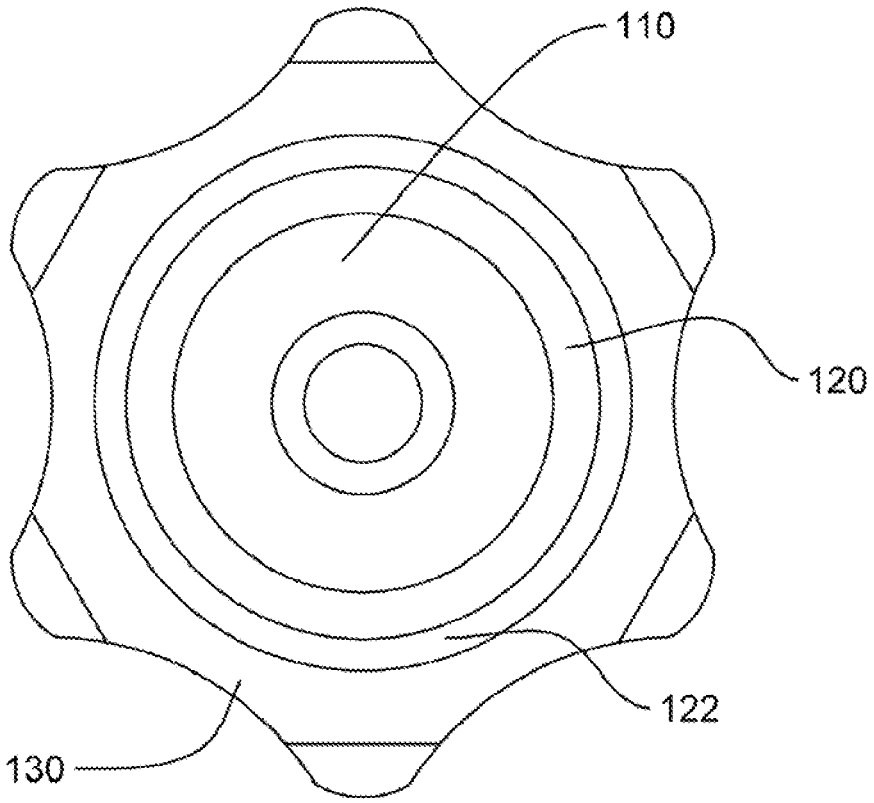
FIG. 6 is a top end view of yet another embodiment of the handle of the present invention without the cap.

FIG. 6 shows another embodiment of the present invention, the difference from the previous embodiment is that the protrusions 122 of the buffering portion 120 is a single protrusion 122 which is an annular flange between the buffering portion 120 and the grasp portion 130.

Figure 7:
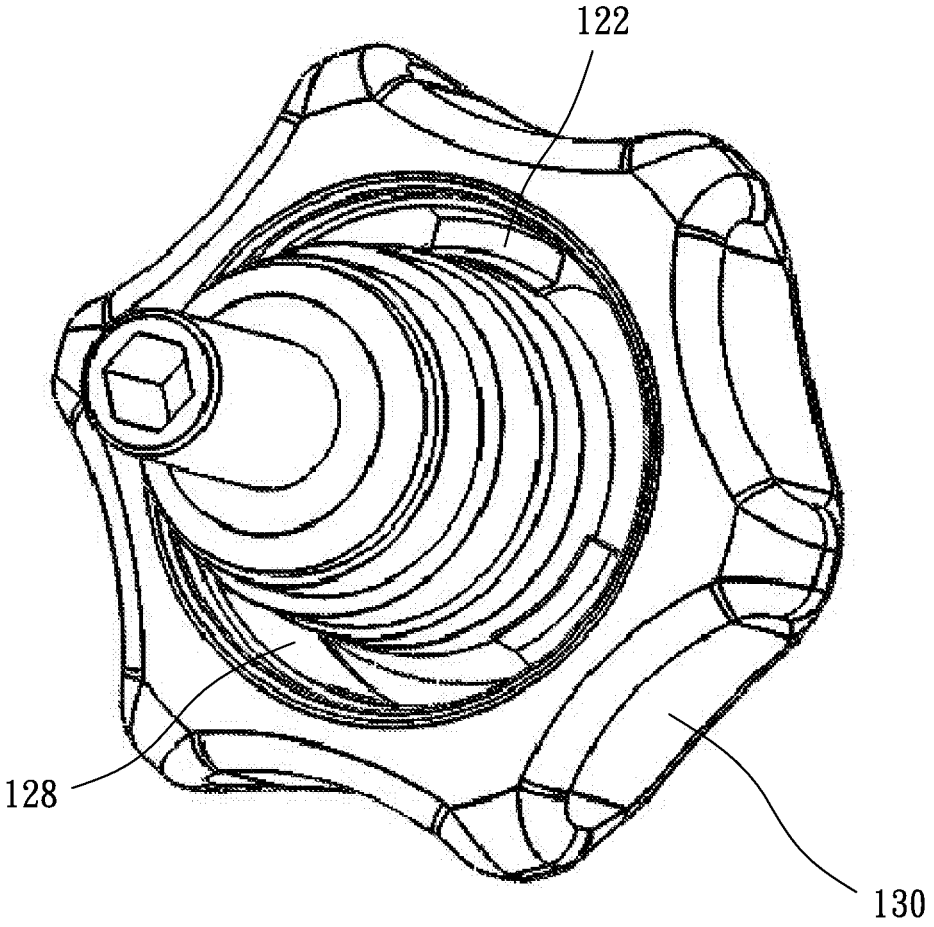
FIG. 7 is a perspective view of an embodiment of a handle of the present invention.
Figure 8:
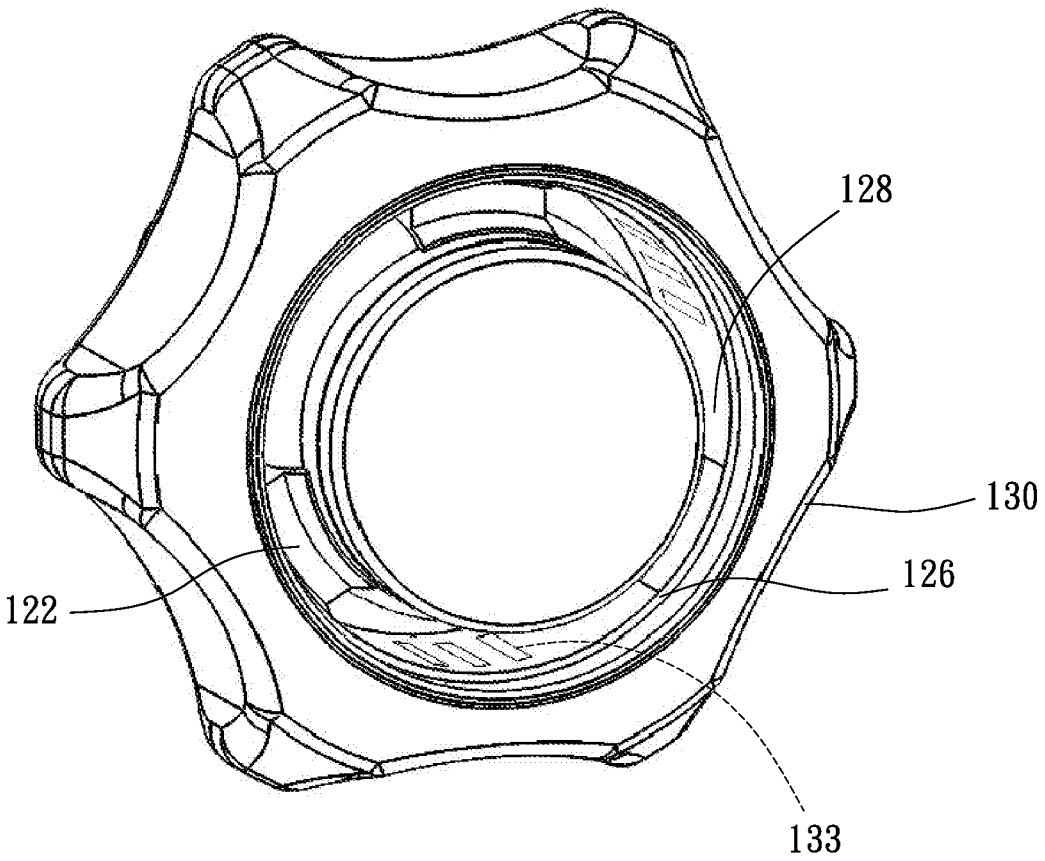
FIG. 8 is another perspective view of an embodiment of a handle of the present invention.
Figure 9:
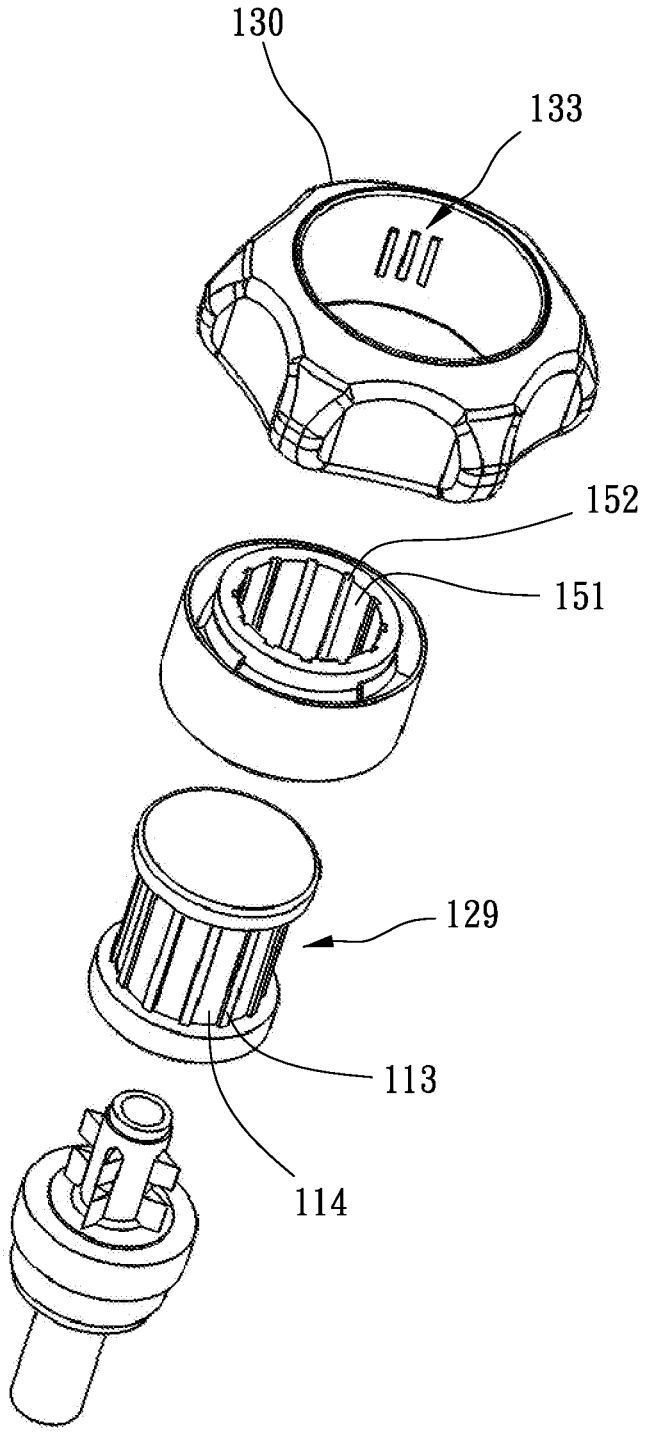
FIG. 9 is a breakdown drawing of FIG. 7.
Figure 10:
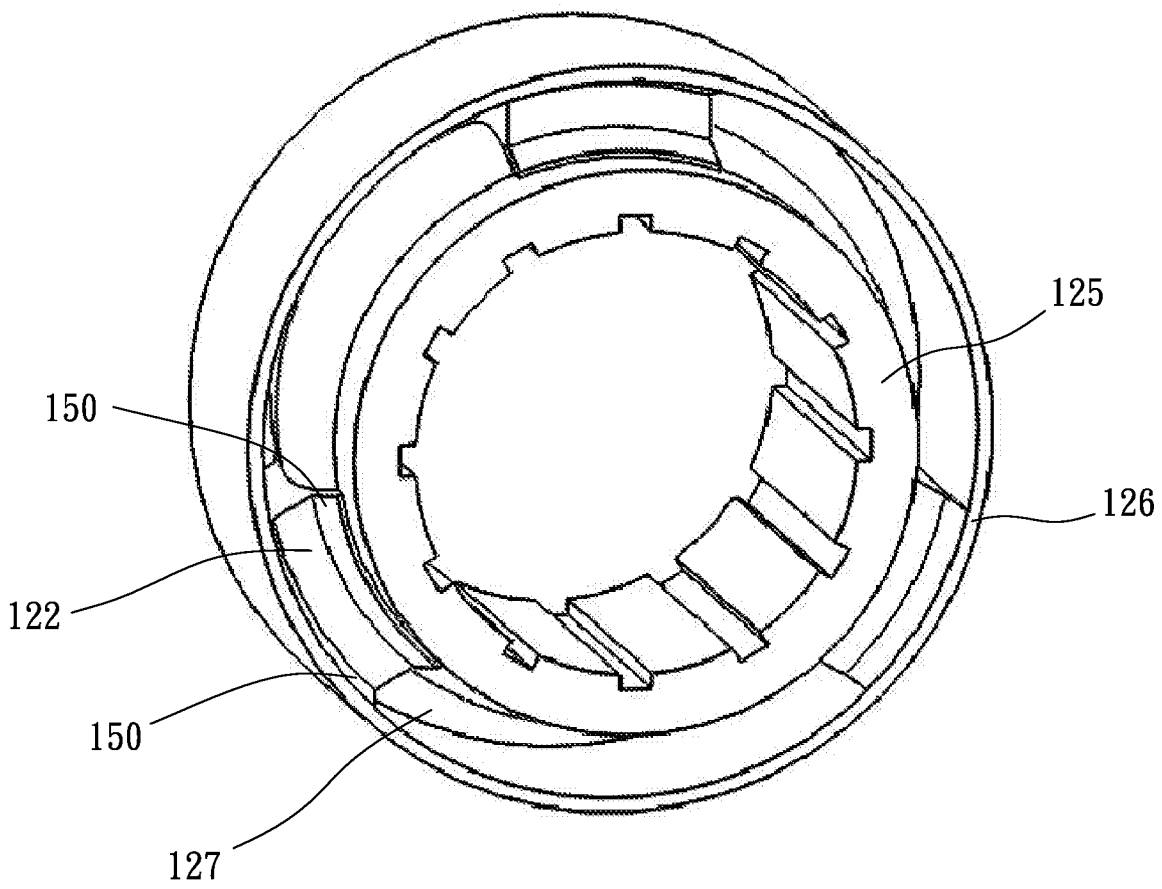
FIG. 10 is a perspective view of a buffering portion of a handle of the present invention.
Figure 11:
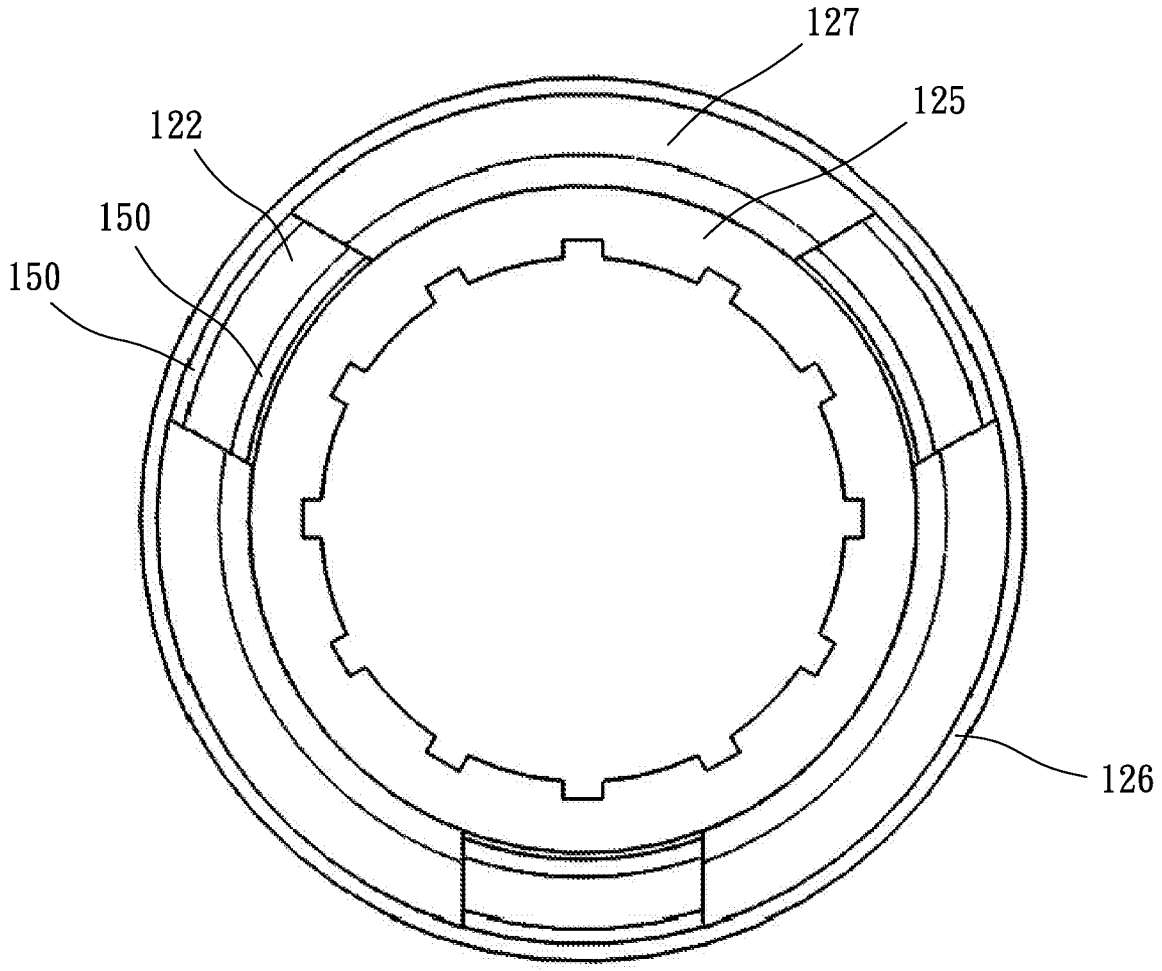
FIG. 11 is a top end view of FIG. 10.
Figure 12:
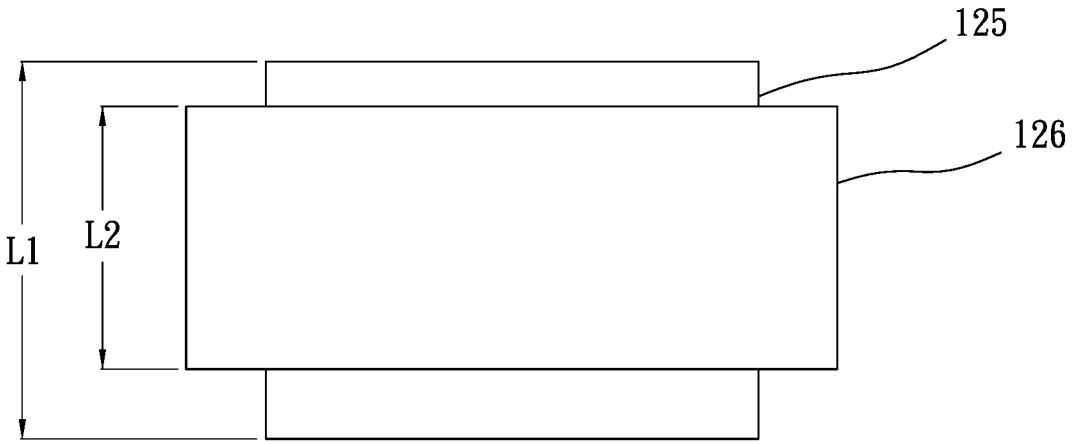
FIG. 12 is a front view of FIG. 10.

Please further referring to FIGS. 7-12, preferably, the buffering portion 120 is integrally formed of one piece and includes an inner annular portion 125, an outer annular portion 126, at least one protrusion 122 and at least one through hole 127 between the inner and outer annular portions 125, 126, the inner annular portion 125 is annularly connected with and around the body 110, the outer annular portion 126 is spacingly disposed around the inner annular portion 125, the at least one protrusion 122 radially extends and is integrally connected with the inner and outer annular portions 125, 126. The grasp portion 130 is integrally connected annularly with and around the outer annular portion 126. An axial extent L1 of the inner annular portion 125 is greater than an axial extent L2 of the outer annular portion 126. The buffering portion 120 includes a plurality of said protrusions 122 which are angularly separately arranged around the body 110, and two adjacent ones of the plurality of said protrusions 122 define one of the through hole 127 which is axially through the buffering portion 120. The plurality of said protrusions 122 are preferably equiangularly arranged on a same plane perpendicular to an axis A of the body 110 (FIGS. 2 and 11). The inner and outer annular portions 125, 126 define two annular grooves 128 therebetween, and the two annular grooves 128 located by two opposite sides of the at least one protrusion 122 and communicated with the at least one through hole 127 (FIGS. 2, 7 and 8). A width W of each of the two annular grooves 128 ranges from 2.0 to 6.0 mm (FIG. 2). A ratio of a total cross-sectional area of the at least one protrusion 122 to a cross-sectional area of each of the two annular grooves 128 is greater than 1:5. Preferably, the body 110 includes an annular recess 129, and the inner annular portion 125 is annular embedded within the annular recess 129. The grasp portion 130 has a largest radial thickness T1 which is at least 1.5 times a radial thickness T2 of the at least one protrusion 122 (FIG. 3). Whereby, the torque by the grasp portion 130 can effectively and smoothly transmitted to the body 110 and the bit 200; the grasp portion 130 can be still effectively operated in a recoverably tilted manner relative to the axis A of the body 110, that is, even if the grasp portion 130 shifts, the bit 200 is still maintained at the proper position to effectively drive the bolt. The buffering portion 120 further includes a plurality of enhancing projecting portions 150 integrally projecting on the inner and outer annular portions 125, 126, and each of the at least one protrusion 122 is integrally connected with two of the plurality of enhancing projecting portions 150 respectively on the inner and outer annular portions 125, 126. The body 110 includes a plurality of ribs 113 extending axially and a plurality of grooves 114 extending axially, and the buffering portion 120 further includes a plurality of ribs 151 which are engaged with the plurality of grooves 114 of the body 110 and a plurality of grooves 152 which are engaged with the plurality of ribs 113 of the body 110. Each of the at least one through hole 127 is at least two times wider than each of the at least one protrusion 122 along a direction around the inner annular portion 125 (FIG. 11). The grasp portion 130 includes a convex-concave structure 133, and the outer annular portion 126 is engaged with the convex-concave structure 133 and fixedly attached to the grasp portion 130 (FIGS. 8 and 9). While we have shown and described various embodiments in accordance with the present invention, it should be clear to those skilled in the art that further embodiments may be made without departing from the scope of the present invention.

What is claimed is:

1. A handle of a hand tool, comprising:

a body made of a first material and adapted to be connected with a bit; a buffering portion made of a second material, the second material having elasticity and being less hard than the first material, the buffering portion including an inner annular portion, an outer annular portion, at least one protrusion and at least one through hole between the inner and outer annular portions, the inner annular portion being annularly connected with and around the body, the outer annular portion being spacingly disposed around the inner annular portion, the at least one protrusion radially extending, the at least one protrusion and the inner and outer annular portions being integrally formed of one piece; and a grasp portion made of third material and integrally connected annularly with and around the outer annular portion, the second material being less hard than the third material;

wherein the buffering portion further includes a plurality of enhancing projecting portions integrally projecting on the inner and outer annular portions, and each of the at least one protrusion is integrally connected with two of the plurality of enhancing projecting portions respectively on the inner and outer annular portions.

2. The handle as claimed in claim 1, wherein an axial extent of the inner annular portion is greater than an axial extent of the outer annular portion.

3. The handle as claimed in claim 1, wherein the buffering portion includes a plurality of said protrusions which are angularly separately arranged around the body, and two adjacent ones of the plurality of said protrusions define one of the through hole which is axially through the buffering portion.

4. The handle as claimed in claim 3, wherein the plurality of said protrusions are equiangularly arranged on a same plane perpendicular to an axis of the body.

5. The handle as claimed in claim 4, wherein a width of each of the two annular grooves ranges from 2.0 to 6.0 mm.

6. The handle as claimed in claim 4, wherein a ratio of a total cross-sectional area of the at least one protrusion to a cross-sectional area of each of the two annular grooves is greater than 1:5.

7. The handle as claimed in claim 1, wherein the inner and outer annular portions define two annular grooves therebetween, and the two annular grooves located by two opposite sides of the at least one protrusion and communicated with the at least one through hole.

8. The handle as claimed in claim 1, wherein the body includes an annular recess, and the inner annular portion is annular embedded within the annular recess.

9. The handle as claimed in claim 1, wherein the at least one protrusion is substantially perpendicular to an axis of the body, and the at least one through hole is axially through the buffering portion.

10. The handle as claimed in claim 1, wherein a cap is connected to a top of the body and the buffering portion.

11. The handle as claimed in claim 10, wherein the body has an annular groove defined in the top thereof, the cap has multiple engaging portions which are engaged with the annular groove such that the cap is rotatable relative to the body and the grasp portion.

12. The handle as claimed in claim 1, wherein the grasp portion has multiple recesses defined in an outer periphery thereof.

13. The handle as claimed in claim 1, wherein the grasp portion has a largest radial thickness which is at least 1.5 times a radial thickness of the at least one protrusion.

14. The handle as claimed in claim 1, wherein the body includes a plurality of ribs extending axially and a plurality of grooves extending axially, and the buffering portion further includes a plurality of ribs which are engaged with the plurality of grooves of the body and a plurality of grooves which are engaged with the plurality of ribs of the body.

15. The handle as claimed in claim 1, wherein each of the at least one through hole is at least two times wider than each of the at least one protrusion along a direction around the inner annular portion.

16. The handle as claimed in claim 1, wherein the grasp portion includes a convex-concave structure, and the outer annular portion is engaged with the convex-concave structure and fixedly attached to the grasp portion.

* * * * *